United States Patent [19]

Nusser et al.

[11] Patent Number: 4,630,578

[45] Date of Patent: Dec. 23, 1986

[54] APPARATUS FOR CONTROLLING THE POSITION OF A THROTTLE DEVICE DISPOSED IN THE INTAKE TUBE OF AN INTERNAL COMBUSTION ENGINE

[75] Inventors: Hermann Nusser, Markgröningen; Klaus-Jürgen Peters, Affalterbach, both of Fed. Rep. of Germany

[73] Assignee: Robert Bosch GmbH, Stuttgart, Fed. Rep. of Germany

[21] Appl. No.: 753,840

[22] Filed: Jul. 11, 1985

[30] Foreign Application Priority Data

Nov. 13, 1984 [DE] Fed. Rep. of Germany ..... 3441404

[51] Int. Cl.[4] ..... F02D 9/02

[52] U.S. Cl. ..... 123/179 G; 261/39.2

[58] Field of Search ..... 123/179 G; 261/39 R, 261/39 A

[56] References Cited

U.S. PATENT DOCUMENTS 3,291,462 12/1966 Mennesson ..... 261/39 A
3,744,470 7/1973 Clarke et al. ..... 123/179 G X
4,104,337 8/1978 Garcea ..... 261/39 A
4,443,388 4/1984 Teramura et al. ..... 261/39 A

FOREIGN PATENT DOCUMENTS 2435258 2/1975 Fed. Rep. of Germany ... 261/39 A

*Primary Examiner*—Willis R. Wolfe, Jr.
*Attorney, Agent, or Firm*—Edwin E. Greigg

[57] ABSTRACT

An apparatus is proposed which serves to control the position of a throttle device disposed in the intake tube of an internal combustion engine. The apparatus includes a lever, which is joined to a shaft of the throttle device and has both a stop screw arranged to cooperate with a stop and an adjusting screw arranged to cooperate with a feeler pin. The feeler pin traces the position of a control body provided with a cam track and the control body can be displaced to a variable extent in a guide bore by means of an expansion element and thereby bring about a variably large rotation of the throttle device and hence a variably large opening of the cross section for the aspirated air during engine idling in the warm-up phase.

6 Claims, 1 Drawing Figure

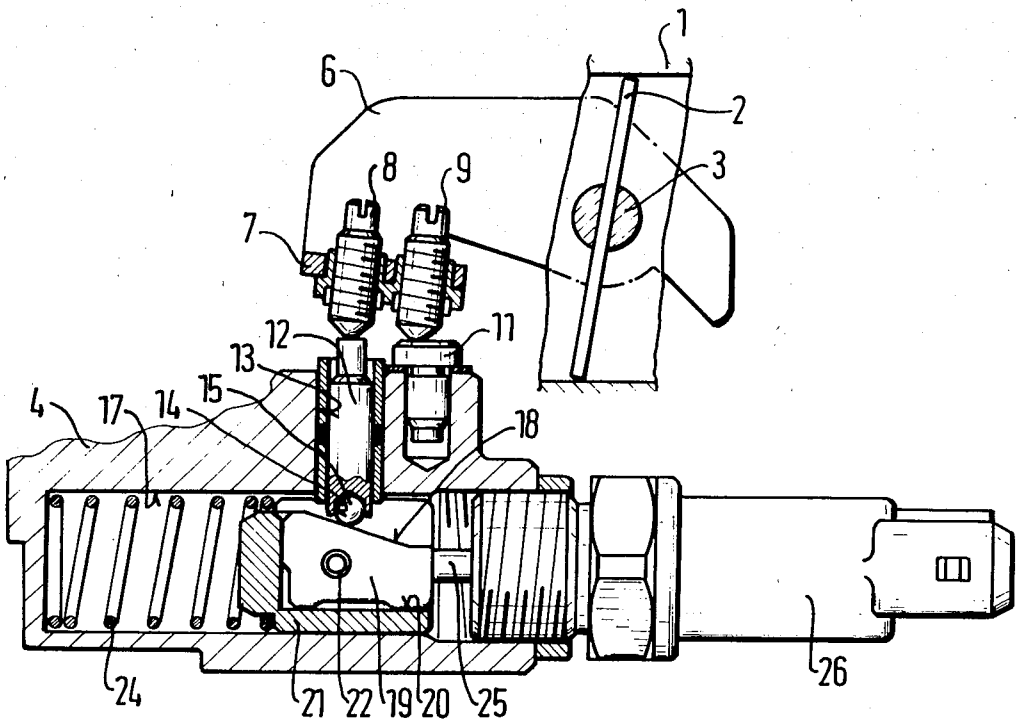
1
2
3
6
7
8
9
11
12
13
14
15
17
18
4
19
20
21
22
24
25
26

APPARATUS FOR CONTROLLING THE POSITION OF A THROTTLE DEVICE DISPOSED IN THE INTAKE TUBE OF AN INTERNAL COMBUSTION ENGINE

BACKGROUND OF THE INVENTION

The invention is directed to improvements in an apparatus for controlling the position of a throttle device disposed in a intake tube.

An apparatus is disclosed in U.S. Pat. No. 3,291,462 to Mennesson in which an expansion element directly engages a lever connected to a throttle valve shaft, in order to effect a slight opening of the throttle valve during the warm-up phase of an internal combustion engine, so that in this engine range, in which there is increased friction, a fuel-air mixture sufficient for reliable engine operation will be made available.

The above patented apparatus presents the disadvantage that the opening or closing movement of the throttle valve during engine warm-up is not effected smoothly and accurately due to a non-linear relationship existing between the rotational angle of the throttle valve and the area at the circumference of the throttle valve that is opened per unit of rotation.

OBJECT AND SUMMARY OF THE INVENTION

The apparatus according to the invention has the advantage over the prior art that despite the use of an expansion element having a linear characteristic, an opening position of the throttle device that is adapted to prevailing operating conditions during engine warm-up can be established because a cam track is interposed between the expansion element and the throttle device.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing illustrates generally in cross-section an exemplary embodiment of the invention.

DESCRIPTION OF THE PREFERRED EMBODIMENT

In the drawing, 1 indicates an intake tube of an internal combustion engine, not otherwise shown, in which a throttle device functioning in a known manner and embodied as a throttle valve 2 is rotatably supported about a shaft 3 counter to the force of a spring, not shown. In the vicinity of the throttle valve 2, the intake tube 1 is as a rule part of a throttle valve assembly 4. A lever 6, which as a rule is disposed outside the throttle valve assembly 4 and has a bent angle section 7, is joined to the shaft 3. An adjusting screw 8 and a stop screw 9 are threaded into the angle section 7, in such a manner that they can each be fixed in a given position. The stop screw 9 is oriented toward a stop 11 disposed immovably with the housing on the throttle valve assembly 4 and after the end of the warm-up phase of the engine the stop screw rests on the stop 11, causing the throttle valve 2 to be held in a slightly open position, so that a quantity of air that is sufficient for engine idling can flow to the engine between the circumference of the throttle valve 2 and the inner wall of the intake tube 1. The adjusting screw 8 is oriented toward a feeler pin 12, which is slidably supported in the throttle valve assembly 4 and protrudes out from a bore 13 of the throttle valve assembly 4 in the direction of the adjusting screw 8. The end of the feeler pin 12 remote from the adjusting screw 8 can have a receiving bore 14, into which a ball 15 is placed and is held movably therein by crimping over the terminal edge of the receiving bore 14. The end of the feeler pin 12 remote from the adjusting screw 8 protrudes with the ball 15 into a guide bore 17 which extends transversely to the bore 13 in the throttle valve assembly 4 and is supported on a cam track 18 of a control body 19 that is displaceably supported in the guide bore 17. The control body 19 may be disposed in a recess 20 of a cylindrical body 21 and secured therein for instance by means of a tensioning pin 22. The cylindrical body 21 is engaged by a restoring spring 24 disposed in the guide bore 17 and is arranged to urge the cylindrical body 21 along with the control body 19 against a pressure pin 25 of an expansion element 26. The expansion element 26 is screwed into the guide bore 17, and by selecting the depth of insertion the correct position of the cam track 18 with respect to the feeler pin 12 can be adjusted for a particular temperature. The expansion element 26 may be provided in a known manner with a built-in electric heater, which is actuated when the ignition switch of the engine is actuated. Furthermore, the expansion element 26 can also be flushed with engine coolant, in a known manner.

When an engine is cold-started, additional air must be supplied in order to overcome the increased friction of the engine during idling. In a known manner, unitl the end of the warm-up phase of the engine the throttle valve 2 is therefore rotated into a more widely open position than it assumes when the engine is warm and at which time the stop screw 9 rests on the stop 11. There is a non-linear relationship between the rotary angle of the throttle valve 2 and the cross section opened at a given time for the air aspirated between the circumference of the throttle valve 2 and the inner wall of the intake tube 1. In contrast to this, the expansion element 26 functions according to a linear characteristic; that is, the pressure pin 25 of the expansion element 26 covers the same distance for each unit of temperature. According to the invention, a cam track 18 is therefore provided on the control body 19 which is embodied such that upon a displacement of the control body 19 by means of the expansion element 26, each temperature change of 1° produces a corresponding rotation of the throttle valve 2 such that a desired, for instance linear, relationship exists between the temperature change at the expansion element 26 and the change in the opening cross section of the throttle valve 2 for the aspirated air quantity. The apparatus is arranged such that at low starting temperatures, by means of the cam track 18 of the control body 19, the feeler pin 12 rotates the adjusting screw 8 and thus the lever 6 in such a manner that the throttle valve 2 is moved in the opening direction, while no later than at temperatures of approximately 80° C. the feeler pin 12 is moved along the cam track 18 so far into the guide bore 17 that the stop screw 9 comes to rest on the stop 11, and the feeler pin 12 is no longer in contact with the adjusting screw 8.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An apparatus comprising a housing, a portion of an intake tube of an internal combustion engine and means for controlling positioning of a throttle device disposed in the intake tube, said throttle device being rotatably supported in said intake tube by means of a shaft, said shaft further arranged to engage a lever, said lever adapted to be actuated by an expansion element, said expansion element further including a control body having a cam track, said cam track being displaceable counter to a force applied by a restoring spring and a feeler pin displaceably supported in the housing arranged to engage said cam track whereby said lever actuates said throttle device.

2. An apparatus as defined by claim 1, further wherein said feeler pin further includes a ball means which engages said cam track.

3. An apparatus as defined by claim 1, further wherein said control body is disposed in a recess of a cylindrical body.

4. An apparatus as defined by claim 1, further wherein said control body is slidably supported in a guide bore.

5. An apparatus as defined by claim 1, further wherein said lever further includes an adjusting screw which is oriented toward said feeler pin.

6. An apparatus as defined by claim 5, further wherein said lever further supports a stop screw which engages a stop means carried by said housing.

* * * * *